United States Patent [19]

Gerber et al.

[11] Patent Number: 4,475,623

[45] Date of Patent: Oct. 9, 1984

[54] UNIVERSAL MUFFLER ASSEMBLY

[75] Inventors: James E. Gerber, Walbridge; Jon W. Harwood; Clinton R. Hay, both of Toledo, all of Ohio

[73] Assignee: APX Group, Inc., Toledo, Ohio

[21] Appl. No.: 422,453

[22] Filed: Sep. 20, 1982

[51] Int. Cl.[3] ..... F01N 7/18

[52] U.S. Cl. ..... 181/243; 181/228; 285/158; 285/390

[58] Field of Search ..... 181/227, 238, 243, 232, 181/241, 282; 285/9 R, 158, 390, 391

[56] References Cited

U.S. PATENT DOCUMENTS

| | | | |
|---|---|---|---|
| 165,893 | 7/1875 | Umland . | |
| 1,015,955 | 1/1912 | Helder | 181/232 |
| 1,021,254 | 3/1912 | Larkins | 181/232 |
| 1,296,016 | 3/1919 | Smith . | |
| 1,465,484 | 8/1923 | Richter . | |
| 1,904,675 | 4/1933 | Boyer . | |
| 1,989,595 | 1/1935 | Hedrick | 285/198 |
| 2,179,193 | 11/1939 | Parrish | 285/146 |
| 2,244,393 | 6/1941 | Haas | 181/243 |
| 2,382,159 | 8/1945 | Klemm | 181/241 |
| 2,476,656 | 7/1949 | Galbraith | 285/146 |
| 2,669,469 | 2/1954 | Finch | 285/158 |
| 2,673,751 | 3/1954 | Finch | 285/175 |
| 2,727,536 | 12/1955 | Tennison . | |
| 2,779,498 | 1/1957 | Cole et al. | 285/158 X |
| 2,936,184 | 5/1960 | Epstein | 285/81 |
| 2,959,196 | 11/1960 | Truesdell et al. . | |
| 3,066,959 | 12/1962 | White | 285/81 |
| 3,129,963 | 4/1964 | Robbins | 285/334 |
| 3,233,923 | 2/1966 | Raider et al. | 285/239 |
| 3,233,927 | 2/1966 | Dewhirst | 285/401 |
| 3,386,529 | 6/1968 | Pannone | 181/243 |
| 3,477,745 | 11/1969 | Williams et al. | 285/390 X |
| 3,581,842 | 6/1971 | Hall | 181/243 |
| 3,813,115 | 5/1974 | French | 285/92 |
| 4,050,721 | 9/1977 | Streit | 285/93 |
| 4,140,422 | 2/1979 | Crumpler, Jr. et al. | 285/401 X |
| 4,184,564 | 1/1980 | Trainor | 181/243 X |
| 4,260,180 | 4/1981 | Halushka et al. | 285/391 X |

*Primary Examiner*—Benjamin R. Fuller

*Attorney, Agent, or Firm*—Anthony J. Casella; Gerald E. Hespos

[57] ABSTRACT

Various universal muffler assemblies are disclosed which allow one or more muffler nipples to be secured to a selected muffler body at the time of installation.

7 Claims, 11 Drawing Figures

UNIVERSAL MUFFLER ASSEMBLY

BACKGROUND OF THE INVENTION

The present invention is directed to the field of replacement mufflers, and more specifically to the field of replacement mufflers which can be used to replace original equipment mufflers without requiring any substantial modifications thereto.

It is well known that automotive exhaust systems, and in particular mufflers, are subject to a great deal of physical and thermal stress, and as a result must often be replaced. Indeed, the muffler replacement industry is quite large.

It has been the practice of the larger muffler replacement companies to stock a full line of replacement mufflers which are substantially identical to the original equipment mufflers. By doing so, the original muffler may typically be replaced by separating the tubes or "nipples" on both sides of the muffler from the exhaust and tail pipes, and by reattaching a substantially equivalent structure to the respective pipes. In some cases however, the downstream nipple is not attached to a separate tail pipe, the downstream nipple itself forming the tailpipe or spout. In such case the original muffler is replaced by separating the upstream nipple from the exhaust pipe and by reattaching the substantially equivalent structure thereto. In either case, the resulting exhaust system is essentially a duplicate of the original system.

Although the above described technique is relatively simple to accomplish, it is expensive since it is necessary to produce and stock from 600 to 800 or more different kinds of mufflers in order to substantially duplicate the original equipment mufflers for the various makes and models of domestic and foreign automobiles. Further, the storage and inventory requirements are indeed prohibitive for all but the largest replacement muffler manufacturers and installers. Still further, since each type of muffler must be made from scratch and requires a significant retooling of the assembly line, a long lead time is many times required when ordering a particular muffler.

A technique for avoiding the problems associated with the above described procedure employs the use of a "universal" muffler which can be used to replace the original equipment on a wide range of vehicles, thus reducing the inventory and storage requirements associated with the above described procedure. One such universal muffler employs a muffler body having an adjustable length, as disclosed in U.S. Pat. No. 2,382,159 to Klemm. Another type of universal muffler employs the use of nipples which are slidably disposed within the muffler body to effect different length connections between the exhaust and tail pipes. An example of such a system is disclosed in U.S. Pat. No. 3,581,842 to Hall.

Still other types of universal mufflers employ nipples produced from drawing quality aluminum killed steel, at least one of which was produced with a longer than average length. The muffler is placed between the exhaust pipe and the tail pipe and if the distance between the two is significantly less than the nipple-to-nipple length of the muffler, the extended length nipple is trimmed so as to allow the muffler to fit between the exhaust and tail pipes. Further, if it is found that the diameters of the exhaust and tail pipes are too large for the nipples provided on the mufflers, the nipple can be opened up to a wider diameter by swaging or otherwise expanding. Examples of such mufflers are disclosed in U.S. Pat. No. 4,164,267, dated Aug. 14, 1979 to Meineke et al., which has since been dedicated to the public, U.S. Pat. No. 4,279,326 dated July 21, 1981, also to Meineke et al., and in the American Muffler Corporation Exhaust Parts Catalog cited in U.S. Pat. No. 4,279,326.

Although the "universal" mufflers can be used on a wide range of automobiles, each type of universal muffler described above has its drawbacks. For example, the universal muffler having the adjustable length muffler body is rather complex, expensive to manufacture, and limited in internal configuration. The universal mufflers having the aluminum killed steel nipples require a considerable amount of time to install and the replacement is not always as aesthetically acceptable as that associated with the "made-to-fit" replacement. Further, the use of the universal mufflers having the aluminum killed steel nipples requires specialized apparatus, such as a swaging tool for increasing the nipple diameters if necessary.

OBJECTS AND SUMMARY OF THE INVENTION

It is therefore and object of the present invention to provide muffler assemblies which overcome the problems associated with the prior art mufflers.

It is a further object of the invention to provide muffler nipples which may be readily secured to selected muffler bodies at the time of installation, or at any other convenient time.

In accordance with a first embodiment, the universal muffler assembly comprises a muffler body having muffler heads at the ends thereof, at least one bushing and a muffler nipple. The bushing is disposed within the muffler body and is connected to one of the muffler heads. The bushing is provided with at least two segmented bushing threads. The nipple has a connector portion which is adapted to be inserted into and secured to the bushing. The connector portion has (i) at least one recess provided to allow part of the connector portion to be inserted past the bushing threads, and (ii) at least two segmented nipple threads adapted to engage the bushing threads when the nipple is rotated within the bushing to thereby secure the nipple within the bushing.

Preferably, two diametrically opposed recesses are provided on the connector portion and four segmented nipple threads are disposed into diametrically opposed pairs on the connector portion, each pair contiguous with an associated recess. Associated four segmented bushing threads are likewise disposed in two diametrically opposed pairs on the bushing. Also, a shank portion is provided on the nipple and is adapted to bear upon the muffler head proximate to the bushing.

In accordance with the second embodiment, the universal muffler assembly includes a muffler body having muffler heads at the ends thereof, at least one pipe connected to the interior of the muffler body, and a nipple. A portion of the pipe extends outside of the body through an aperture in one of the muffler heads. The pipe is provided with pipe threads at the portion extending outside of the muffler body. The nipple is provided with a nipple portion, a sealing portion and nipple threads therebetween adapted to engage the pipe threads when the nipple is rotated about the portion of the pipe extending outside the muffler body. The sealing portion is adapted to abut the muffler head when the nipple is secured to the pipe. Preferably, the sealing portion is outwardly flared and the pipe and nipple threads are continuous.

In accordance with the third embodiment, the universal muffler assembly comprises a muffler body having muffler heads at the ends thereof, a pipe connected to the interior of the muffler body and a nipple. At least one of the muffler heads is provided with an aperture therethrough. The pipe connected to the interior of the muffler body is in alignment with the aperture, and the end of the pipe adjacent to the aperture is provided with pipe threads. The nipple is provided with nipple threads at one end thereof and is adapted to be inserted into the aperture and rotated relative to the pipe such that the pipe threads engage the nipple threads. Preferably, a tight fit is adapted to be provided between the nipple and the head, the pipe threads are adapted to be threaded inside the nipple threads and the pipe and nipple threads are continuous.

In accordance with a fourth embodiment, the universal muffler assembly comprises a muffler body having heads at the ends thereof, a pipe connected to the interior of the muffler body, an internally threaded, cylindrical insert and a nipple. At least one of the muffler heads is provided with an aperture therethrough, and the pipe connected to the interior of the muffler body is also connected to the aperture at one end of the pipe. The insert is adapted to be inserted into the one end of the pipe. The nipple is provided with a nipple portion, a threaded portion and a sealing portion therebetween, the threaded portion having threads which are adapted to engage the internally threaded cylindrical insert when the threaded portion is inserted into and rotated within the insert. Preferably, the insert is provided with a flange adapted to be disposed on the outside of the muffler head and the sealing portion is adapted to abut the flange when the nipple is secured to the insert. The relative diameters of the pipe, insert and threaded portion are preferably such that the threaded portion is adapted to cause the insert to forceable bear upon the pipe when the nipple is secured to the insert. Also, the threads are preferably continuous.

BRIEF DESCRIPTION OF THE DRAWINGS

These and other objects, aspects and embodiments of the invention will be described with reference to the following drawing figures of which.

DETAILED DESCRIPTION OF THE INVENTION

As used throughout the specification and claims, the term "nipple" will be deemed to include the tubes on both sides of the muffler, whether they are attached to exhaust or tail pipes, or whether they form an exhaust pipe or spout without further connection to an external pipe.

Figure 1A:
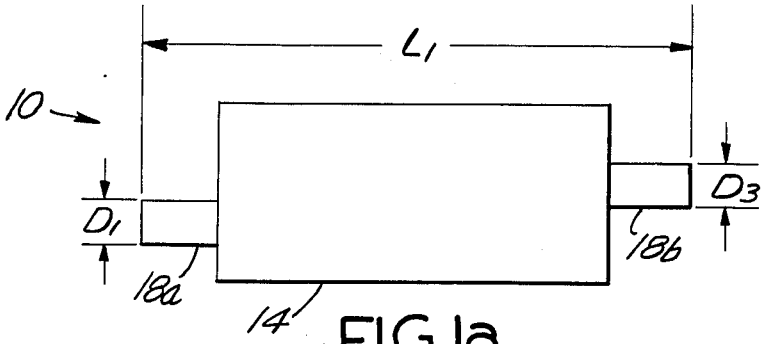
FIGS. 1A and 1B are plan views illustrating a pair of replacement mufflers having different nipple-to-nipple lengths and diameters, both of which may be made from the same muffler body in accordance with the present invention.
Figure 1B:
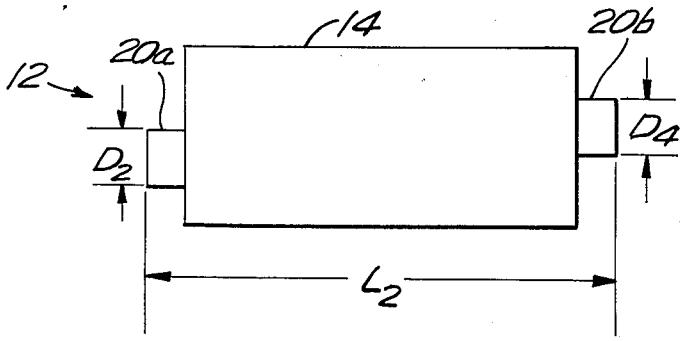

FIGS. 1A and 1B illustrate a pair of mufflers 10 and 12 having essentially identical muffler bodies 14 and respective pairs of muffler nipples **18*a*/18*b* and 20*a*/20*b* in accordance with the present invention. Muffler 10, provided with muffler nipples 18*a* and 18*b* is adapted to replace an original equipment muffler having a nipple-to-nipple distance $L_1$ and nipple diameters $D_1$ and $D_3$, while muffler 12, provided with nipples 20*a* and 20*b* which are shorter and of greater diameter than nipples 18*a* and 18*b***, is adapted to replace an original equipment muffler having a nipple-to-nipple distance of approximately $L_2$ and nipple diameters $D_2$ and $D_4$.

Those skilled in the art will appreciate that if the nipple pairs **18*a*/18*b* and 20*a*/20*b* could be secured to the muffler bodies 14 at the time of installation, great savings in inventory requirements and cost can be achieved. Since muffler bodies 14** can be used interchangeably with different sets of muffler nipples, many different types of replacement mufflers can be produced from the same muffler body, and may thus be used to replace a wide range of original equipment mufflers. More specifically, the muffler installer who would otherwise stock either exact duplicates of the original equipment mufflers, which would require an inventory of 600 to 800 different types of mufflers, or the universal mufflers which require the special nipple swaging and trimming operations, would be able to stock a relatively small number of different types of muffler bodies and a full line of muffler nipples which would allow the muffler bodies to be "customized" to replace virtually any original equipment muffler by providing the appropriate nipple-to-nipple distance and nipple diameters. Stated differently, by stocking 60 to 80 different types of basic muffler bodies, a full line of 600 to 800 or more different types of replacement mufflers could be produced, assuming that each of the 60 to 80 body styles could be fit, on the average, with approximately 10 different sets of muffler nipples.

Due to the size and expense of producing an individual muffler body, compared to the size and expense of producing muffler nipples, it will be appreciated that a muffler installer could greatly increase his operating efficiency by stocking relatively few different types of muffler bodies and a larger number of customized muffler nipple sets. Since the nipple portions of the muffler are smaller and more cheaply and readily produced, a large number of the different types of nipples may be easily stored and readily manufactured upon demand.

Thus, either of mufflers 10 or 12 can be produced by using the same muffler body 14 by selectively securing either of muffler nipple pairs 18*a*/18*b* or 20*a*/20*b*, respectively, to the muffler body. The various ways in which the selected muffler nipples can be secured to the muffler body will be discussed in detail with reference to FIGS. 2–9.

Figure 2:
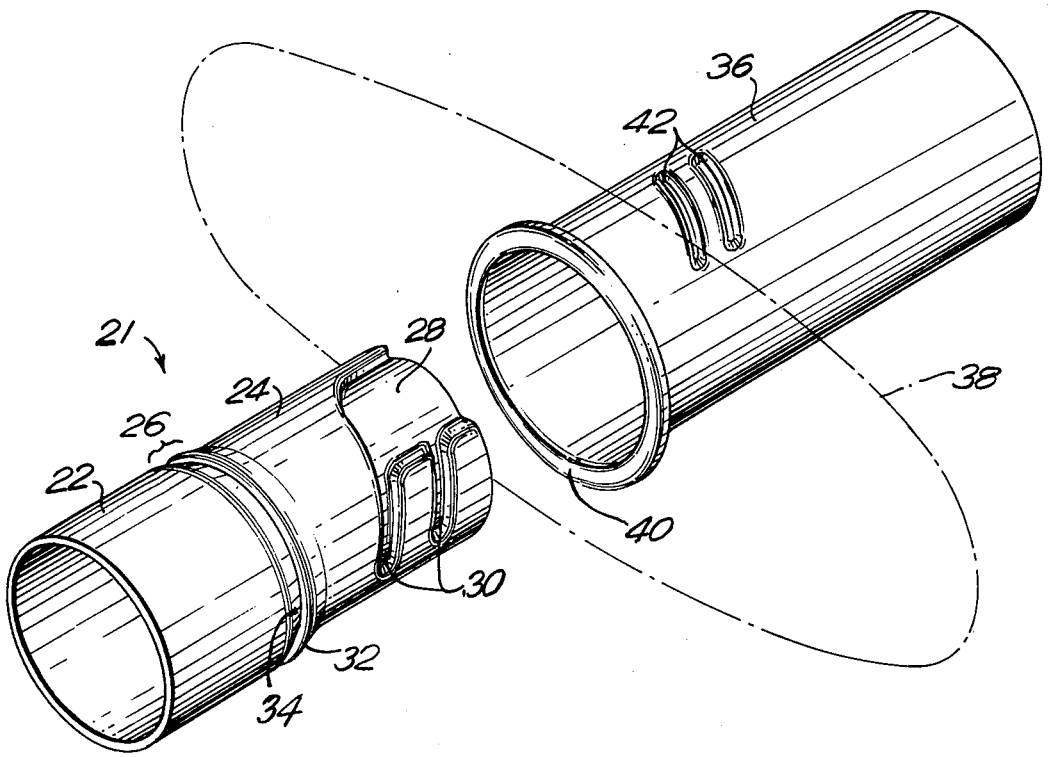
FIG. 2 is a perspective view of the bayonet type muffler nipple and associated bushing in accordance with a first embodiment of the present invention.
Figure 3A:
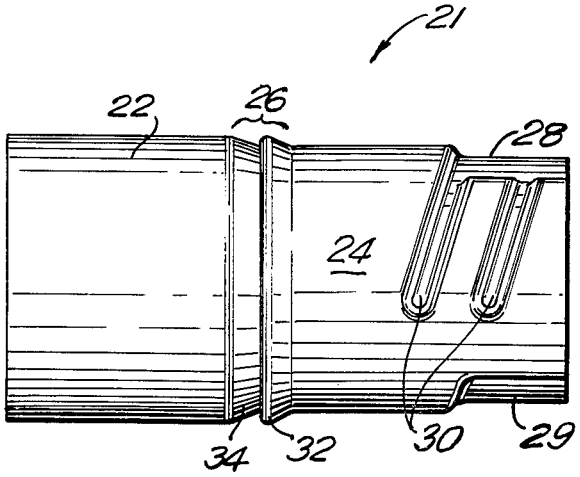
FIG. 3A is a plan side view of the bayonet nipple illustrated in FIG. 2.
Figure 3B:
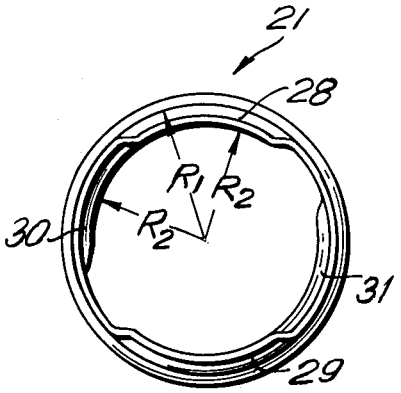
FIG. 3B is a front plan view of the muffler nipple illustrated in FIG. 2.
Figure 4:
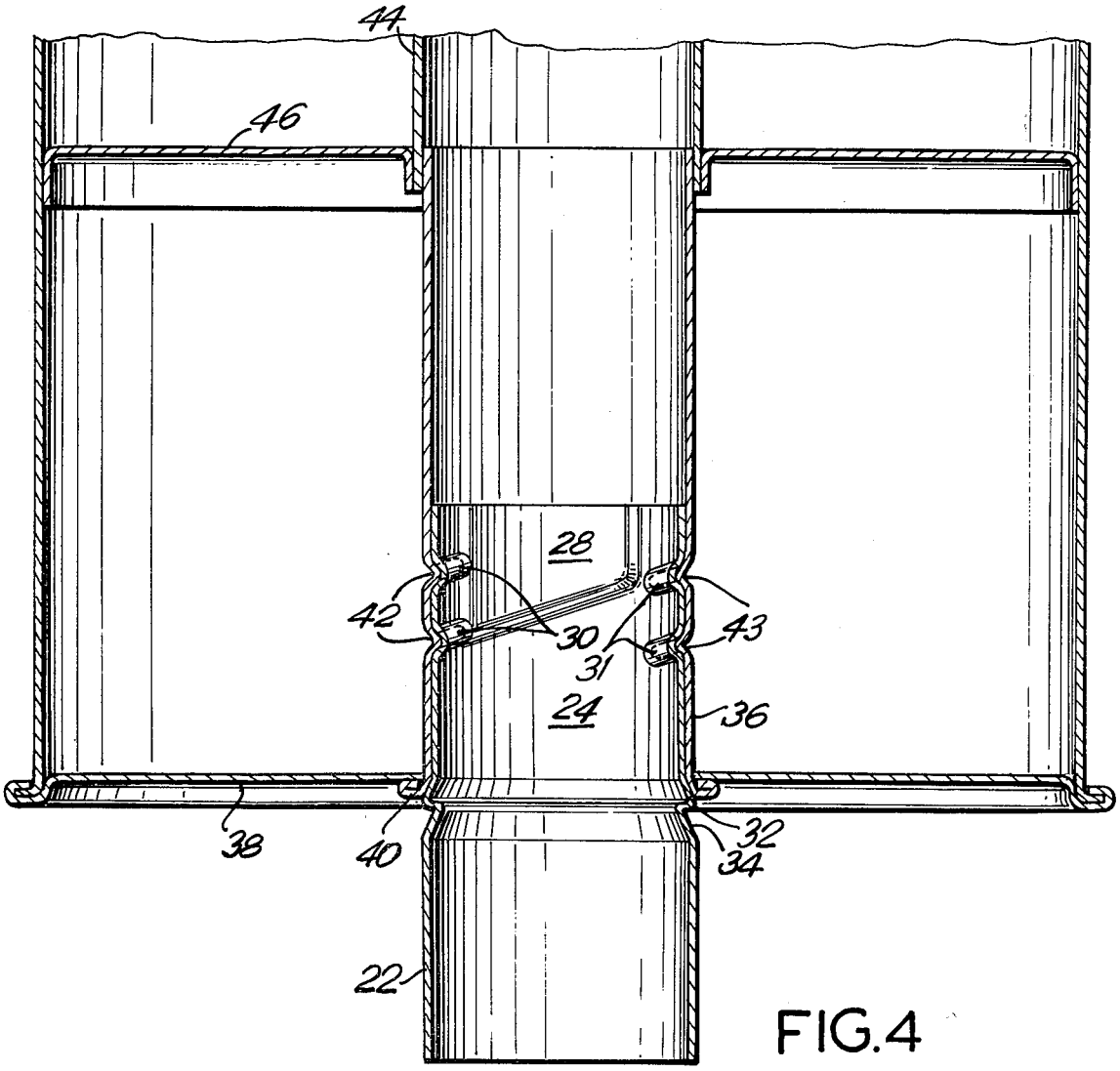
FIG. 4 is a cross-sectional view of the bayonet nipple secured to the muffler bushing.

The "bayonet" type nipple assembly in accordance with the first embodiment of the invention is shown in FIGS. 2–4. The bayonet nipple 21 is provided with nipple portion 22, bayonet connector portion 24 and intermediate portion 26 provided between the nipple portion 22 and the bayonet connector portion 24. The bayonet connector portion 24 is provided with a pair of diametrically opposed recesses 28 and 29, as best illustrated in FIGS. 3A and 3B. Circumferentially extending from and contiguous with the recesses 28 and 29 are respective pairs of locking threads 30 and 31. The surface of the connector portion 24 is provided with a radius $R_1$ and the recesses 28 and 29 are inwardly recessed in a radial direction from the surface of the connector portion 24 to thus provide a radius $R_2$ smaller than $R_1$. The locking thread pairs 30 and 31 are provided with the same degree of recess as recesses 28 and 29 and are thus provided with the same radius $R_2$, as illustrated in FIG. 3B. Although only one pair, 30, of the locking threads is illustrated in FIGS. 2 and 3A, the other pair, 31, of locking threads extend from the diametrically opposing side of the connector portion 24, as illustrated in FIG. 3B.

Intermediate portion 26 is provided with a shank 32 adjacent to the bayonet connector portion and a circumferential indentation or recess 34 adjacent to the nipple portion 22.

As shown in FIG. 2, a bushing 36 is provided into which the bayonet connector portion 24 is adapted to be inserted, rotated and thus secured thereto. The bushing 36 is mechanically locked to the muffler head 38, as best shown in FIG. 4, and shown in phantom in FIG. 2. The bushing 36 is connected at one end to the muffler head 38 by means of a mechanical lock, or other similar expedient, which thereby forms an annular bead 40 about the intersection of the bushing 36 and muffler head 38. The bushing 36 is provided with two diametrically opposed pairs of inwardly extending threads 42 and 43 which are positioned on the bushing 36 so as to threadedly engage the two locking thread pairs 30 and 31, respectively, on the bayonet connector portion 24. Although only one pair, 42 of the inwardly extending threads is shown in FIG. 2, both, 42 and 43, are shown in cross-section in FIG. 4. As shown in FIG. 4, the other end of the bushing 36 is disposed within an internal pipe 44 held stationary within the muffler by a baffle 46 or other suitable means.

In operation, a bayonet type nipple having a nipple portion with the desired dimensions (length and diameter) is selected from a plurality of such nipples having different size nipple portions 22 but a common size bayonet connector portion 24. Thus, the muffler may be provided with virtually any nipple length and diameter. The bayonet connector portion 24 of the selected nipple is inserted into the bushing 36. The nipple is lined up such that the inwardly extending thread pairs 42 and 43 in the bushing 36 are lined up with the recesses 28 and 29 to thus allow part of the bayonet connector portion 24 to be inserted past the threads 42 and 43 and thus fully inserted into the bushing, shank 32 coming into abutment with bead 40, as illustrated in FIG. 4. The nipple may then be rotated in a counter-clockwise direction to thereby engage the locking thread pairs 30 and 31 with the inwardly entending threads 42 and 43, respectively. The nipple may then be torqued sufficiently to complete the connection.

The angles, depths, pitch, and locations of the threads 30, 31, 42 and 43 may be determined in accordance with the design parameters discussed in great detail in co-pending U.S. Patent Application Ser. No. 405,922, entitled "Threaded Muffler Nipple and Bushing", by Clegg et al., filed on Aug. 6, 1982, and assigned to the assignee of the present invention, the entire disclosure of which is hereby incorporated by reference. Although the co-pending application is directed to the use of continuous threads, the analysis contained therein is equally applicable to the segmented threads provided in the bayonet type embodiment. It must be noted however, that the torque which may be achieved using the bayonet type arrangement is limited (to approximately 45 foot pounds) by the physical length of the threads which may tend to disengage at high torques. Other various parameters such as the angle of the shank 32, may also be found with reference to the copending application Ser. No. 405,922. The circumferential recess 34 may be employed to provide a degree of vibrational isolation of the connector portion 24 from the nipple portion 22, as more fully described in co-pending application. Although not shown in the other embodiments of the present invention illustrated in FIGS. 5–9, the circumferential recess 34 may be provided in any of the other embodiments as desired.

Figure 5:
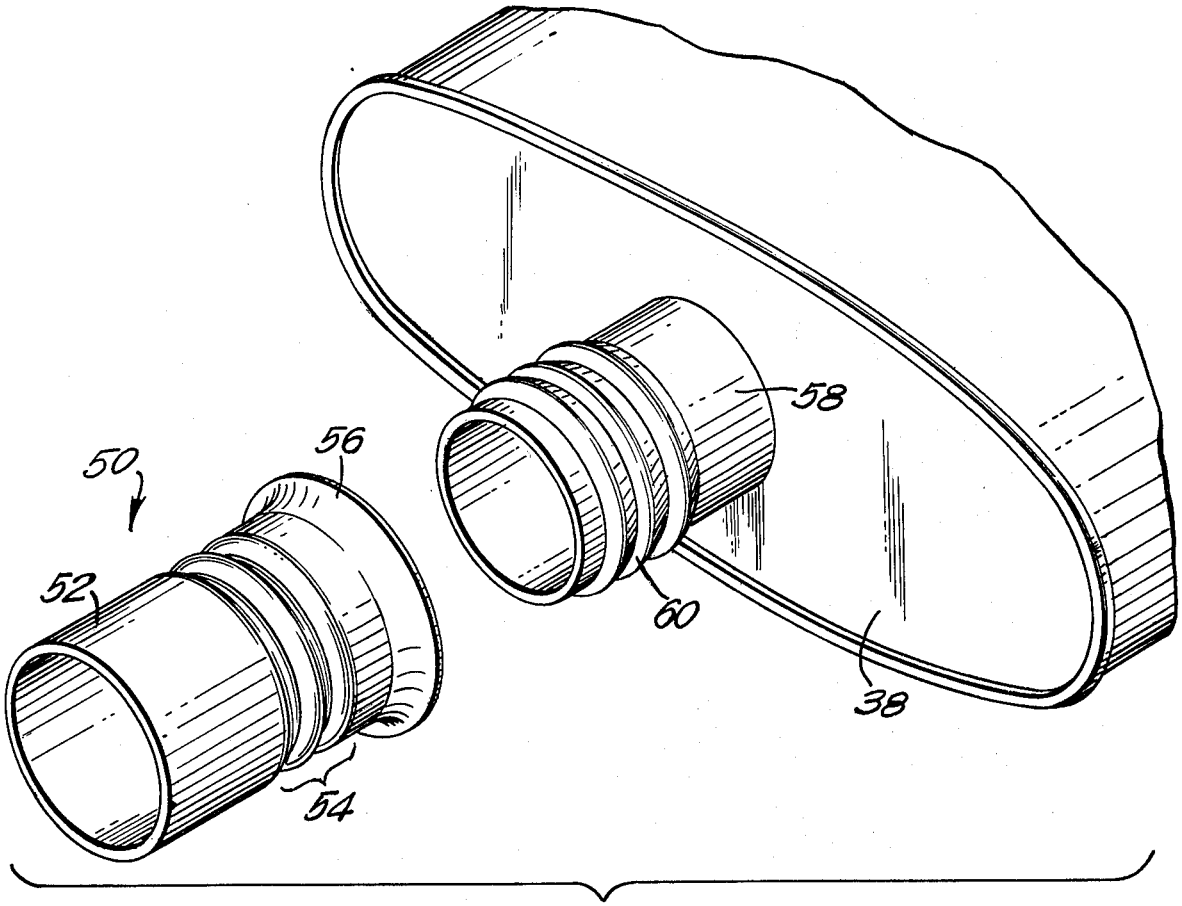
FIG. 5 is a perspective view of a threaded muffler nipple and threaded pipe extension in accordance with a second embodiment of the present invention.
Figure 6:
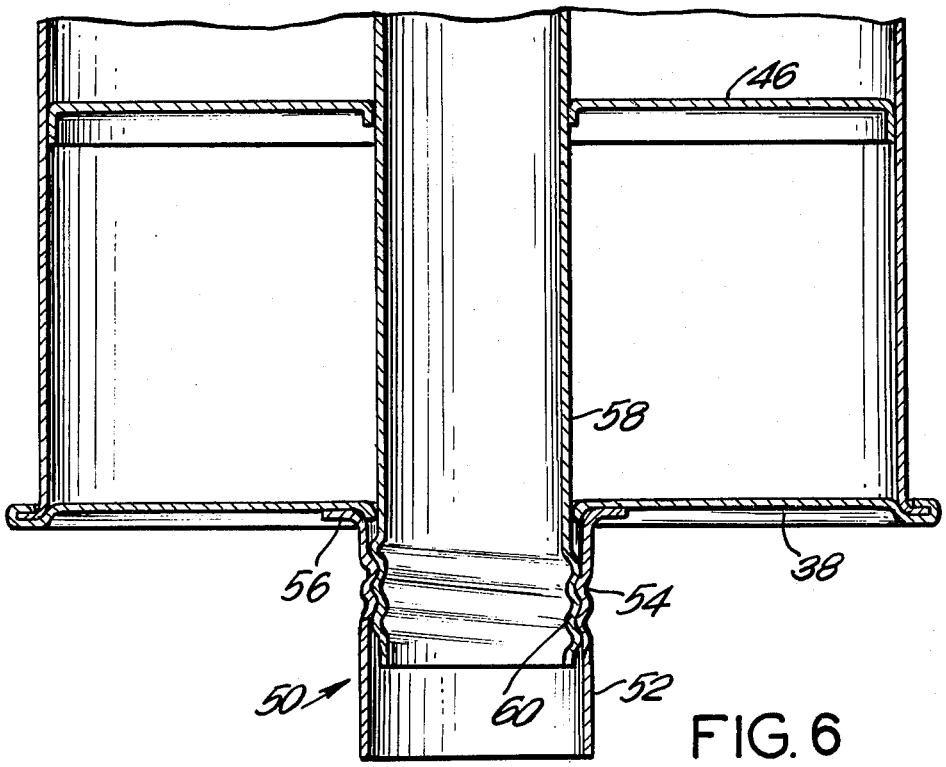
FIG. 6 is a cross-sectional view of the muffler nipple of FIG. 5 secured to the threaded pipe extension.

The threaded muffler nipple in accordance with the second embodiment of the present invention will now be described with reference to FIGS. 5 and 6. Wherever possible, like reference numerals will be used to denote identical or similar structures illustrated in the various figures. A threaded nipple 50 is provided with a nipple portion 52, a flared sealing portion 56 and a threaded portion 54 therebetween. The threaded nipple 50 is secured to the muffler head 38 by means of a threaded, extended pipe 58. As shown in FIG. 6, the extended pipe 58 is internally secured to the muffler by means of baffle 46 and extends outside of the muffler a short distance beyond the muffler head 38. The portion of the extended pipe 58 which extends beyond the head 38 is provided with threads 60 adapted to threadedly engage the threaded portion 54 of the threaded nipple 50. The extended pipe 58 may be welded to one or both of the head 38 or baffle 46, as desired. The flared sealing portion 56 is adapted to securely abut the head 38 when the threaded nipple 50 is tightened onto the extended pipe 58, thus forming a substantially gas tight seal between the nipple 50 and head 38. Again, the design of the various thread and nipple parameters may be in accordance with the design criteria set forth in the co-pending U.S. Patent Application Ser. No. 405,922.

Figure 7:
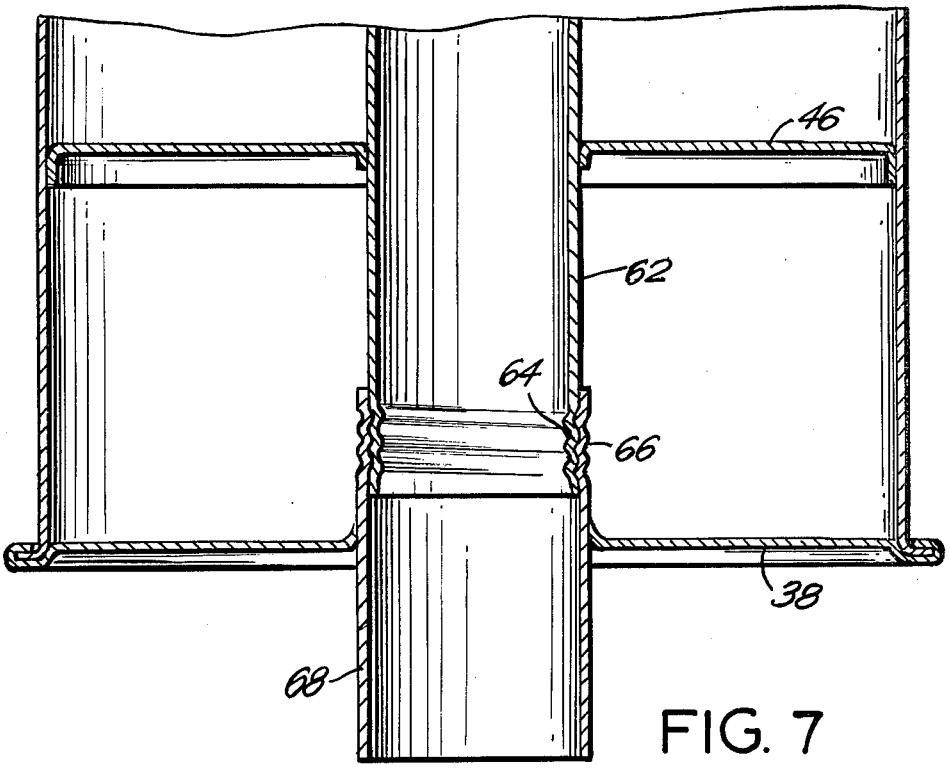
FIG. 7 is a cross-sectional view of the threaded muffler nipple secured to an associated threaded pipe within a muffler body in accordance with a third embodiment of the present invention.

The third embodiment of the present invention is shown in FIG. 7 and is similar to the second embodiment discussed with reference to FIGS. 5 and 6. However, unlike the second embodiment, the threaded pipe to which the nipple is secured does not extend beyond the muffler head 38. Rather, the third embodiment illustrated in FIG. 7 is provided with a threaded pipe 62 which terminates within the muffler. The threaded pipe 62 is secured to the baffle 46 by welding or other means and is provided with threads 64 adapted to threaded engage threads 66 on the end of the threaded muffler nipple 68. Since the seal between the head 38 and the threaded nipple 68 is effected at an intermediate point along the nipple, rather that at the end thereof, as in the case of the second embodiment (FIG. 6), no flared sealing portion is required at the end of the threaded nipple 68. Rather, the seal between the head 38 and the nipple 68 is effected by a tight mechanical fit between the two. This embodiment may be considered more aesthetically acceptable than the second embodiment since no threads can be seen after installation of the nipples, but the connection formed in the second embodiment is of higher quality than this embodiment due to the tight abutment of the flared sealing portion 56 to the head 38.

Figure 9:
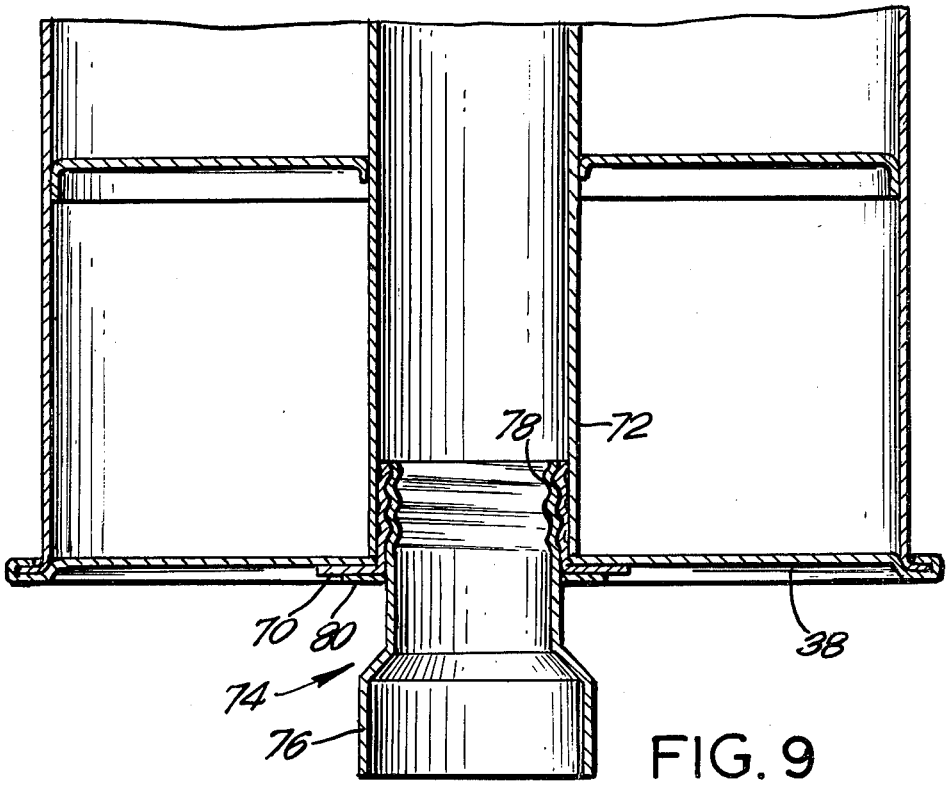
FIG. 9 is a cross-sectional view of the threaded muffler nipple of FIG. 8 secured to the associated threaded insert within the muffler body.
Figure 8:
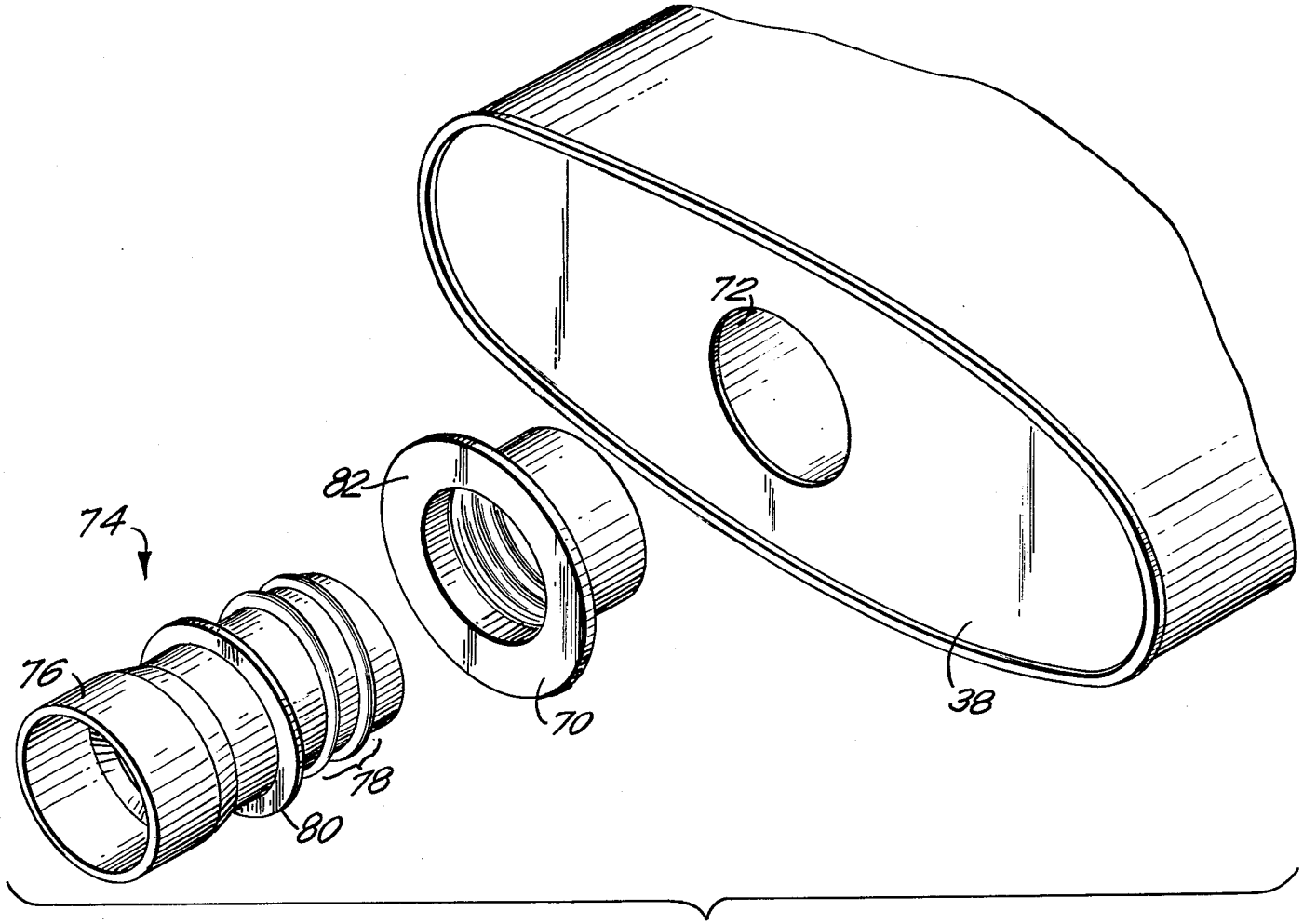
FIG. 8 is a perspective view of the threaded muffler nipple and threaded insert assembly in accordance with a fourth embodiment of the present invention.

The fourth and final embodiment of the invention will now be discussed with reference to FIGS. 8 and 9. Unlike the prior embodiments, the fourth embodiment employs a flanged threaded insert 70 which is adapted to be inserted into an internal pipe 72 which is connected at one end to the muffler head 38. Preferably, the threaded insert 70 is threaded exclusively at its interior, thus providing a substantially flat cylindrical outer surface to thereby facilitate the insertion of the insert into the internal pipe. Preferably, a tight fit relationship between the threaded insert 70 and the internal pipe 72 is employed, and the abutting surfaces may be finished so as to increase the coefficient of friction therebetween. The threaded muffler nipple 74 in accordance with this embodiment of the invention is provided with nipple portion 76, threaded portion 78 and sealing portion 80 between the nipple and threaded portions. The threaded portion 78 is provided with threads adapted to be threadedly engaged by the threads on the threaded insert 70. The threaded portion 78 is provided with an outer diameter slightly greater than that provided by the inner diameter of the threaded insert 70 to thus increase the force with which the threaded insert bears upon the internal pipe 72. Again, the threads may be designed in accordance with the design criteria set forth in the co-pending U.S. Patent Application Ser. No. 405,922.

The sealing portion 80, or sealing boss, is provided by a generally disc shaped member disposed substantially perpendicular to the pipe and nipple axes. The sealing portion 80 is adapted to tightly bear upon the flange 82 of the threaded insert 70 to thus provide a tight seal between the nipple and the insert. The nipple portion 76 as shown in FIGS. 8 and 9 is slightly flared to provide a nipple diameter greater than that of the threaded portion 78. Of course, other nipples may employ different size nipple portions as desired, to produce a muffler having the desired nipple dimensions.

Thus, the four embodiments of the present invention provide various techniques for producing a universal muffler assembly. Although the invention has been described with reference to the foregoing specification and drawings, it is to be understood that many modifications and changes to the invention may be made without departing from the spirit and scope thereof. The scope of the invention will be defined with reference to the following claims.

What is claimed is:

1. A muffler assembly comprising:

a muffler body having muffler heads at the ends thereof;

at least one bushing disposed within the muffler body and connected to one of the muffler heads, said bushing being provided with at least two segmented bushing threads; and a nipple having a nipple portion, an intermediate portion and a connector portion, said nipple portion being adapted to be inserted into and secured to said bushing, said connector portion having (i) at least one recess provided to allow part of the connector portion to be inserted past the bushing threads, and (ii) at least two segmented nipple threads adapted to engage said bushing threads when said nipple is rotated within said bushing to thereby secure the nipple within the bushing, said nipple portion adapted to be disposed outside said muffler body when said connector portion is secured to said bushing, said intermediate portions being disposed between said nipple and connector portions, said intermediate portion including a shank adapted to come into contact with and bear upon said muffler head proximate to said bushing when the nipple is secured thereto.

2. The muffler assembly of claim 1 wherein two diametrically opposed recesses are provided on the connector portion, four segmented nipple threads are disposed in two diametrically opposed pairs on the connector portion, each pair contiguous with an associated recess, and an associated four segmented bushing threads are likewise disposed in two diametrically opposed pairs on the bushing.

3. A muffler assembly comprising:

a muffler body having muffler heads at the ends thereof;

at least one pipe connected to the interior of the muffler body, a portion of the pipe extending outside of said body through an aperture in one of the muffler heads, the pipe having pipe threads at said portion extending outside said body; and a nipple having a nipple portion, an outwardly flared sealing portion, and nipple threads therebetween adapted to engage said pipe threads when said nipple is rotated about said portion of the pipe extending outside of said body, said sealing portion adapted to securely abut and impart an axial force on the muffler head when the nipple is secured to the pipe.

4. The muffler assembly of claim 3 wherein said pipe threads and said nipple threads are continuous.

5. A muffler assembly comprising:

a muffler body having muffler heads at the ends thereof, at least one of the heads having an aperture therethrough;

a pipe connected to the interior of the muffler body, and to the aperture at one end of the pipe;

an internally threaded, cylindrical insert adapted to be inserted into said one end of the pipe, said insert including a flange adapted to be disposed on the outside of said muffler head; and a nipple having a nipple portion, a threaded portion, and a sealing portion therebetween, said threaded portion having threads which are adapted to engage said internally threaded cylindrical insert when said threaded portion is inserted into and rotated within in said insert, said sealing portion being adapted to abut said flange when the nipple is secured to the insert.

6. The muffler assembly of claim 5 wherein the relative diameters of the pipe, insert and threaded portion are such that said threaded portion is adapted to cause said insert to forceably bear upon the pipe when the nipple is secured to the insert.

7. The muffler assembly of claim 6 wherein said threads are continuous.

* * * * *